US005630587A

United States Patent [19]

Zlotsky

[11] Patent Number: 5,630,587

[45] Date of Patent: May 20, 1997

[54] MANIPULATIVE GAME

[76] Inventor: Dmitry Zlotsky, 59 W. Cedar St., Livingston, N.J. 07039

[21] Appl. No.: 536,381

[22] Filed: Sep. 29, 1995

[51] Int. Cl.[6] ..... A63F 9/08

[52] U.S. Cl. ..... 273/155; 446/111

[58] Field of Search ..... 273/153 R, 155, 273/153 S, 156, 157 R; 434/478, 211, 215, 216; 446/105–112, 124

[56] References Cited

U.S. PATENT DOCUMENTS

| | | | |
|---|---|---|---|
| 646,661 | 4/1900 | Hanstein | 446/105 |
| 2,057,942 | 10/1936 | Fay | 446/112 |
| 3,003,260 | 10/1961 | Bassetti | 446/115 |
| 3,927,489 | 12/1975 | Bernstein | 446/124 |
| 3,987,580 | 10/1976 | Ausnit | 446/109 |
| 4,426,821 | 1/1984 | Moore et al. | 446/109 |
| 4,717,214 | 1/1988 | Moore et al. | 446/487 |
| 4,875,681 | 10/1989 | Ofir | 273/155 |
| 5,299,804 | 4/1994 | Stevens | 446/487 |

FOREIGN PATENT DOCUMENTS

| | | | |
|---|---|---|---|
| 101572 | 4/1965 | Denmark | 446/111 |
| 140329 | 3/1920 | United Kingdom | 446/111 |
| 2219216 | 12/1989 | United Kingdom | 273/157 R |

OTHER PUBLICATIONS

"suppliers to Toymakers", Playthings, p. 63.

*Primary Examiner*—Steven B. Wong

[57] ABSTRACT

A manipulative game comprising a frame and a plurality of game elements, having planar sides matching in shape and size to planar sides of the frame. Each of the game elements includes a plurality of disconnectable means of attachment which, when connected permit a hinge-like rotation of a game element around the frames' rib. The game elements further include visual or tactile indicia on their planar surfaces, which in the assembled state, or otherwise in the initial state of order form a predefined pattern. In the initial state all game elements are connected to planar sides of the frame via means of attachment. When the game is to be used, all but one game element's means of attachment of one game element are disconnected, permitting said game element to be rotated around the frame's rib using the element's only connected means of attachment, thus freeing a side of the frame so that another game element may be rotated around one of its edges and occupy the first game element's initial location and at the same time freeing it's own initially occupied frame's side, allowing still another game element's move. The object of the game is to achieve a predefined pattern of game elements' indicia by disconnecting means of attachment, rotating game elements around said frame's edges and reconnecting the game elements to an adjacent side of the frame via available means of attachment. The game may optionally exclude the frame, allowing game elements to connect to one another. Another object of the game in the latter implementation is to connect game elements achieving attractive geometric forms and/or indicia patterns.

9 Claims, 6 Drawing Sheets

MANIPULATIVE GAME

BACKGROUND OF THE INVENTION

This invention relates generally to logical games, and, more particularly, to three dimensional manipulative puzzles. It is known to provide manipulative games wherein a plurality of elements have visual indicia and where the object of the game is to achieve a predefined pattern of indicia via a series of consecutive moves of the game's elements. For a successful game it is important not only to challenge a player with a logical or manipulative task but to present an attractive tangible design and an attractive idea behind a particular implementation of the game.

SUMMARY OF THE INVENTION

The invention provides a game comprising a substantially three dimensional frame, consisting of mutually connected linear elements, ribs, and a plurality of game elements, having planar sides matching in shape and size to planar sides of said frame. Each of the game elements comprises a plurality of disconnectable means of attachment. Said means of attachment may be implemented as side edges or beads, extending from game elements, that are retained in grooves formed in corresponding edges of the frame or another game element and when connected permit a hinge-like rotation of a game element. One linear element of the frame comprises a plurality of said grooves so as to permit a simultaneous connection of more than one game element to the same linear element of the frame. Said game elements have visual or tactile indicia on their planar surfaces, which in the assembled state, or otherwise in the initial state of order, match indicia of adjacent game elements or form a predefined pattern.

In the initial state all game elements are each connected to planar sides of the frame via means of attachment. When the game is to be used all but one means of attachment of one game element are disconnected, permitting said game element to be rotated around the frame's rib using the element's only connected means of attachment, thus freeing a side of the frame so that another game element may be rotated around another frame's rib and occupy the first game element's initial location and at the same time freeing it's own initially occupied frame's side, allowing still another game element's move. Game elements are thus "mixed up" or otherwise placed in random order. The object of the game is to achieve a predefined pattern of game elements' indicia by rotating game elements around the ribs of said frame.

In one embodiment, game elements are substantially (excluding indicia) two dimensional in form, i.e. having two planar surfaces.

In one embodiment, game elements are substantially three dimensional, i.e. having more than two planar surfaces, and may, but don't have to have a shape of a Platonic solid.

The invention also provides a game comprising a plurality of game elements, wherein each element comprises a plurality of detachable means of attachment which, when connected, permit a hinge-like rotation of one game element around another. Said game elements have visual or tactile indicia on their plane surfaces, which in the assembled state form a predefined pattern or constitute a three dimensional figure of a predefined shape. The object of the game is to mix-and-match patterns of adjacent game elements' indicia by rotating the game elements around the game element's edge, attached to the adjacent game element. Yet another object of the game is to join game elements via means of attachment, achieving attractive shapes and visual patterns.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENTS

Figure 1:
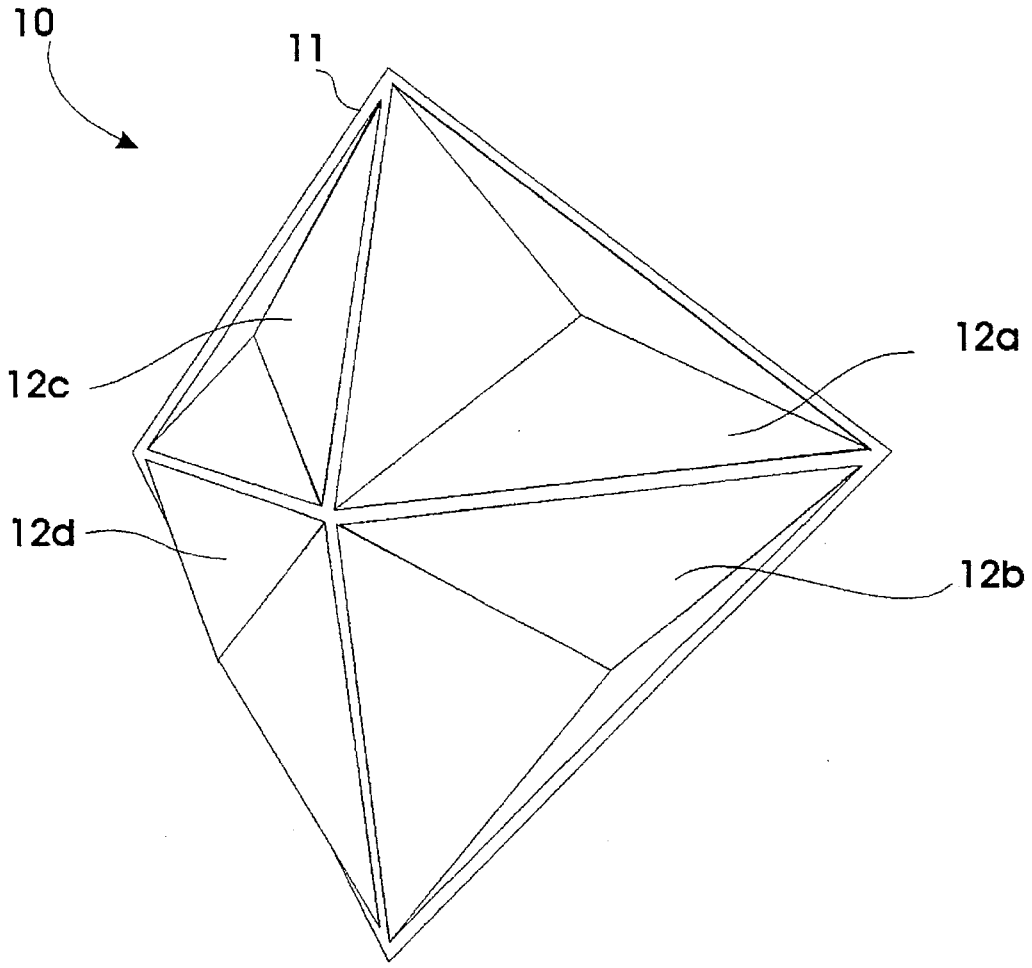
FIG. 1 shows an isometric view of a game constructed in accordance with various aspects of the invention.
Figure 2:
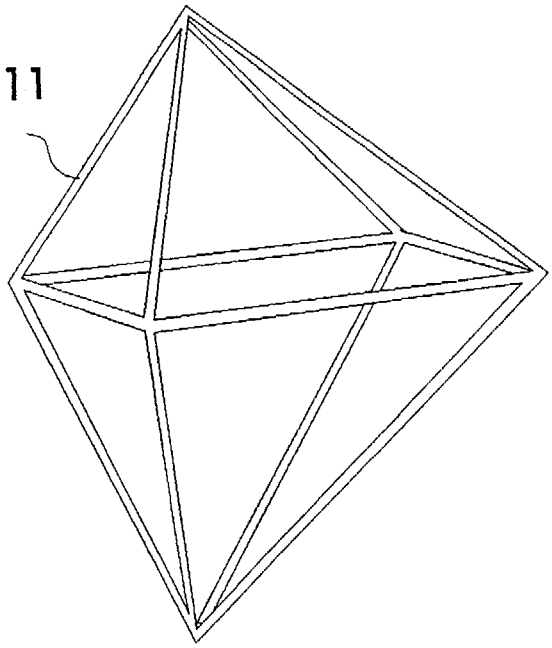
FIG. 2 shows an isometric view of a frame of the game shown in FIG. 1.
Figure 3:
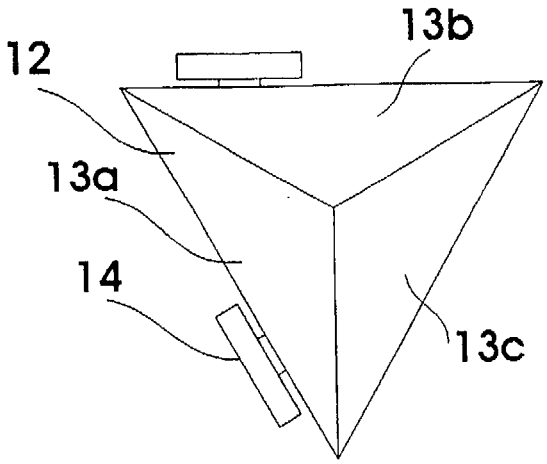
FIG. 3 shows a game element for the game shown in FIG. 1.
Figure 4:
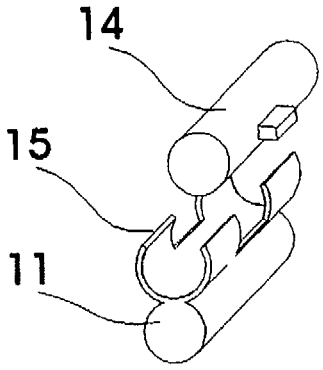
FIG. 4 shows examples of a disconnectable hinge-like means of attachment of the game shown in FIG. 1.

Referring to the drawings, and, in particular to FIG. 1, a logical game 10 constructed in accordance with various aspects of the invention is illustrated. In the illustrated embodiment, the puzzle includes a frame 11 and game elements 12*a*–12*d*. The frame 11, shown in FIG.2, in the illustrated embodiment has the general form of a octahedron and the game elements 12, shown in FIG.3, have planar surfaces substantially conforming in shape and size to planar surfaces of the frame 11. In the illustrated embodiment game elements are substantially two dimensional (have two planar surfaces) and have a form of equilateral triangles. Game elements 12 further contain visual or tactile indicia 13*a*–13*c* on some or all of their planar surfaces. Game elements 12, as shown in FIG.3 comprise at their edges means of attachment to frame 11 (side 14) in such a way that would allow a game element 12 to discount all but one means of attachment of the game element 12 and rotate the element around the only attached connection so as to permit the game element to attach to another planar surface of the frame 11, adjacent to the side of the game element's original attachment. Such means may, but don't have to be implemented as detachable hinge like connectors as shown in FIG.4. Said connectors comprise a side 14 attached to game element 12 and a groove 15 attached to a fib of the frame 11 and provide a predetermined angle of rotation of side 14 in groove 15. Said means of attachment are located in such a way so as to enable a simultaneous attachment of more than one game element to the same rib of frame 11.

Figure 5:
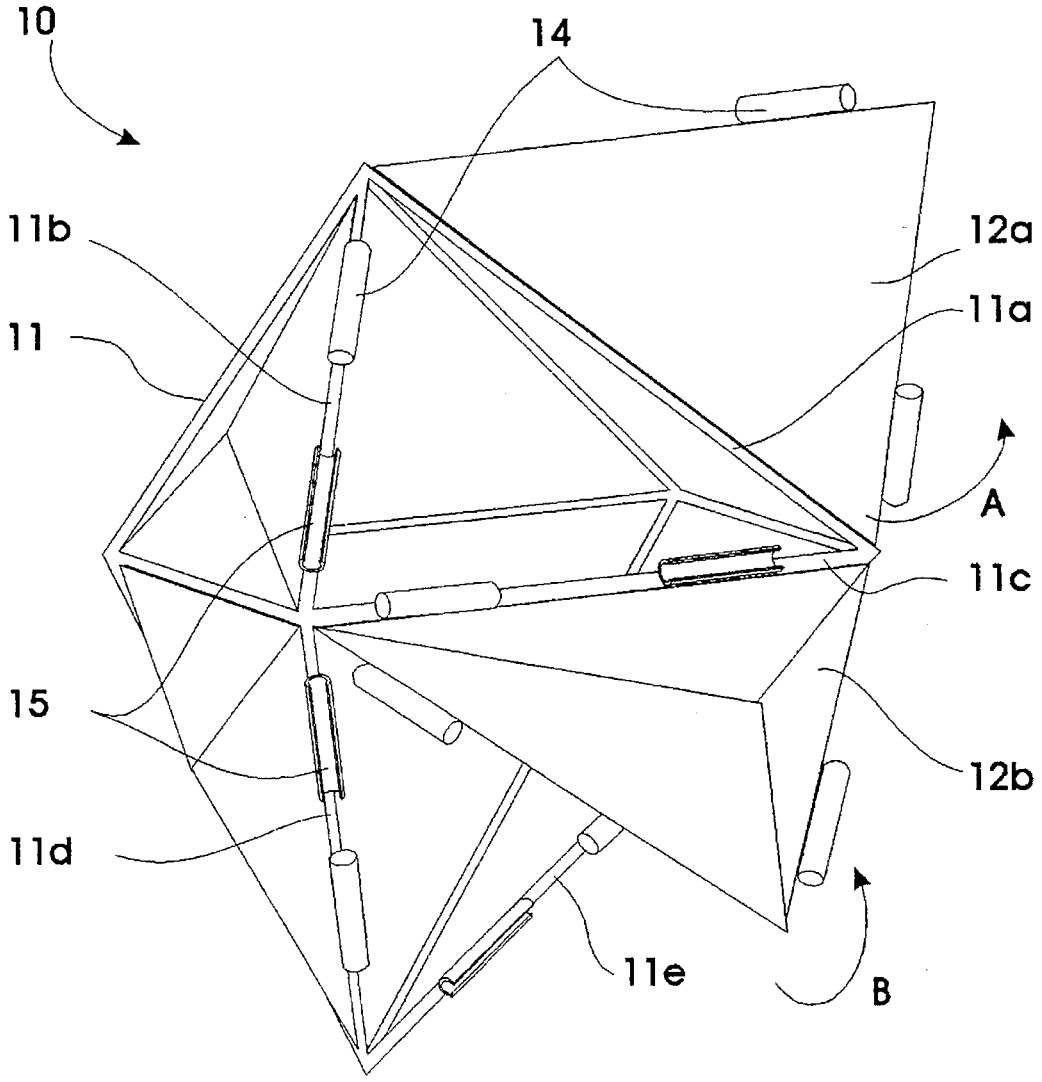
FIG. 5 shows a sequence of game elements' moves for the game shown in FIG. 1.

FIG.5 illustrates "moves" of game elements 12. First the means of attachment of the game element 12*a* are discounted from ribs 11*b* and 11*c* of the frame 11, keeping its means of attachment connected to rib 11*a* and rotates around said rib 11*a* in the direction shown by arrow A. Secondly, game element 12*b* is detached from ribs 11*d* and 11*e* of the frame 11, keeping its means of attachment connected to rib 11*c* and rotates around said rib 11*c* in the direction towards game element 12*a* former location, as shown by arrow B. Then, if there are available means of attachment, game element 12*b* may be attached to the former location of game element 12*a* on the frame 11, i.e. to the ribs 11*b* and 11*c*. FIG. 5 also illustrates the location of sides 14 and grooves 15 of the means of attachment.

The object of the game is to achieve a predetermined visual or tactile pattern of game elements' indicia by a series of game elements' rotations.

In one embodiment game elements 12 are substantially two dimensional, i.e. have two planar surfaces—"top" and "bottom" and may include visual or tactile indicia on one or both surfaces.

Figure 6:
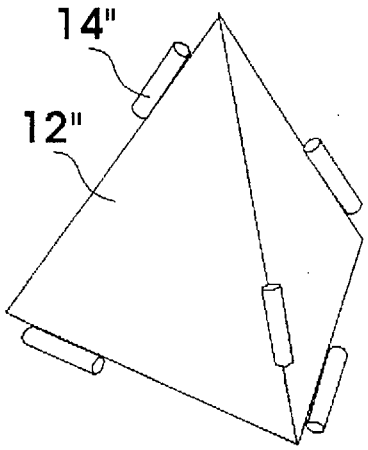
FIG. 6 shows an isometric view of another embodiment of the game element, having means of attachment along all edges, for the game shown in FIG. 1.
Figure 6A:
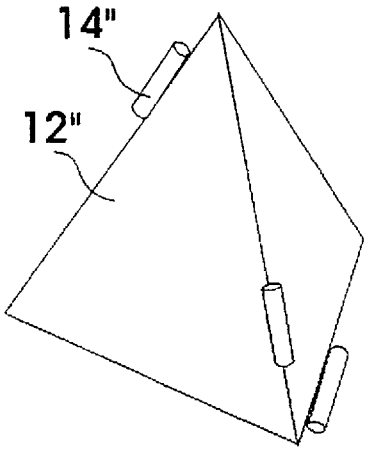
FIG. 6*a* shows an isometric view of another embodiment of the game element, having means of attachment along some, but not all edges, for the game shown in FIG. 1

In another embodiment game elements 12" are substantially three dimensional, i.e. have a shape of a tetrahedron, as illustrated in FIG. 6, and may include visual or tactile indicia on the planar surfaces. Game elements 12" further include side connectors 14" along all edges of the game elements, FIG. 6, or along some, but not all, edges of the game elements, FIG. 6*a*.

Figure 7:
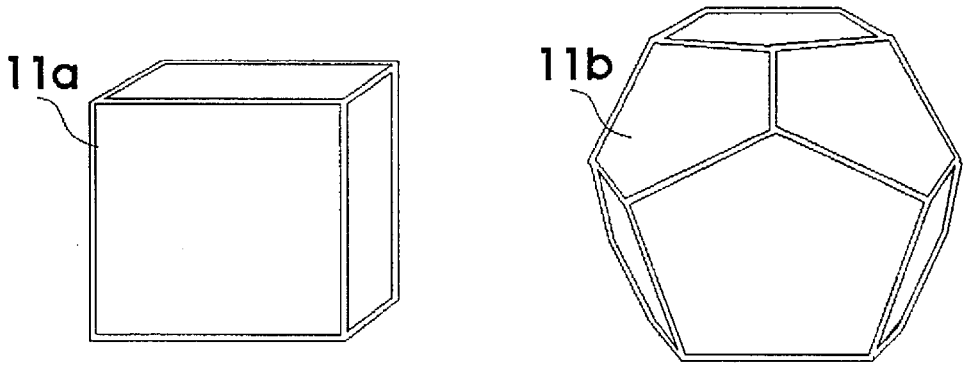
FIG. 7 shows examples of frame shapes for a game constructed in accordance with various aspects of the invention.
Figure 7A:
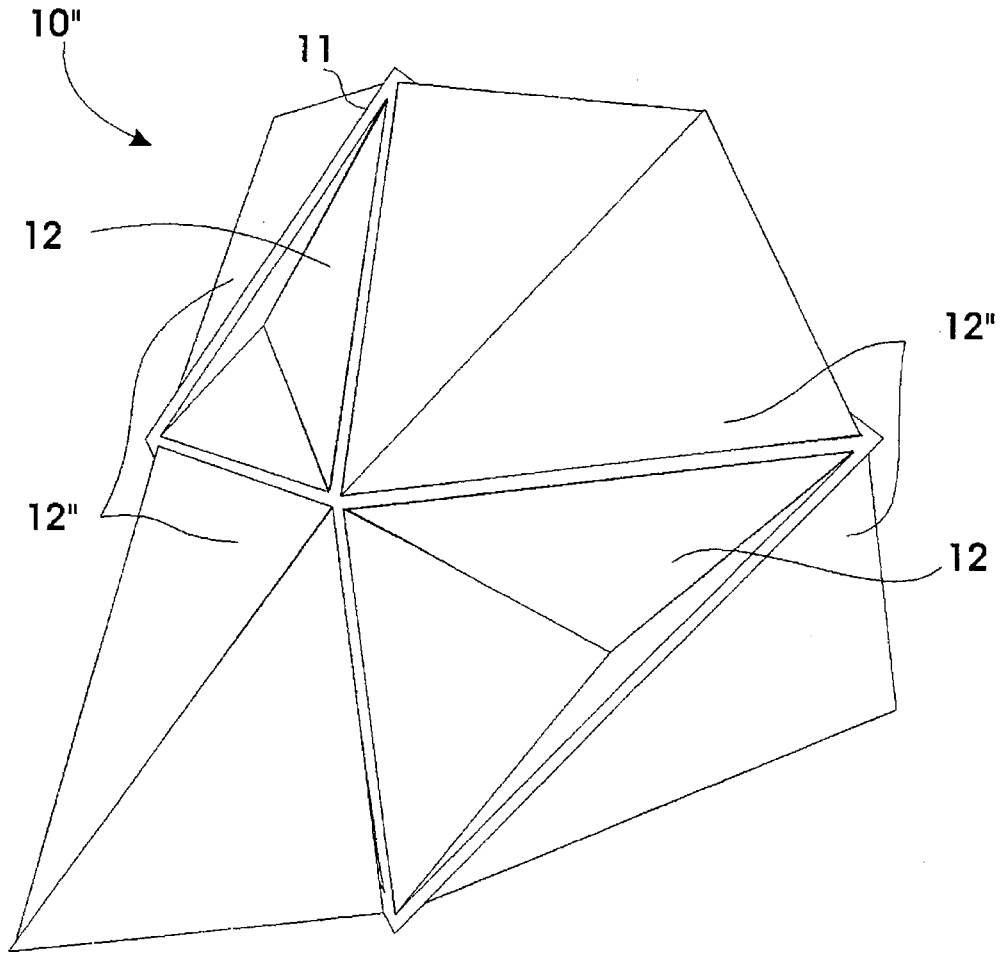

Still another embodiment of the invention 10" may comprise a frame and both two dimensional game elements 12 and three dimensional game elements 12" as shown in FIG.7*a*.

Alternate embodiments of the frame 11*a* and 11*b* are illustrated in FIG.7. In these embodiments frame 11*a* has a shape of cube and frame 11*b* has a shape of a dodecahedron. In these embodiments the shape of game elements will vary in accordance with the shape of planar surfaces of the frame.

Although the specific shapes of the frame and game elements are described, they can be varied in order to change the relative difficulty of the game.

Figure 8:
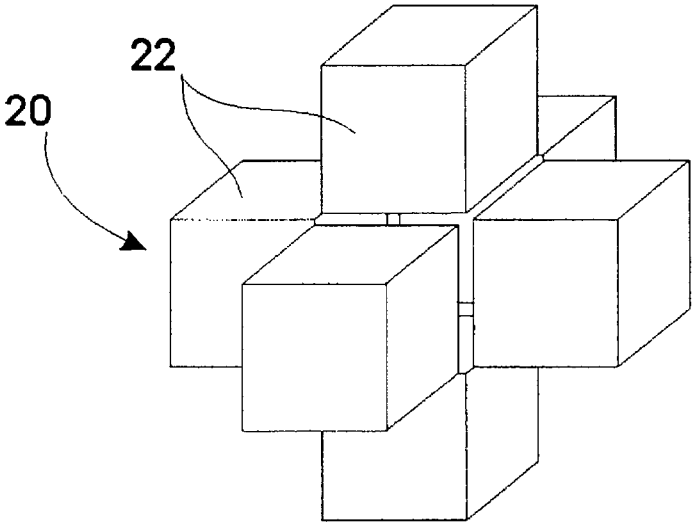
FIG. 8 shows an isometric view of a frameless game constructed in accordance with various aspects of the invention.
Figure 9:
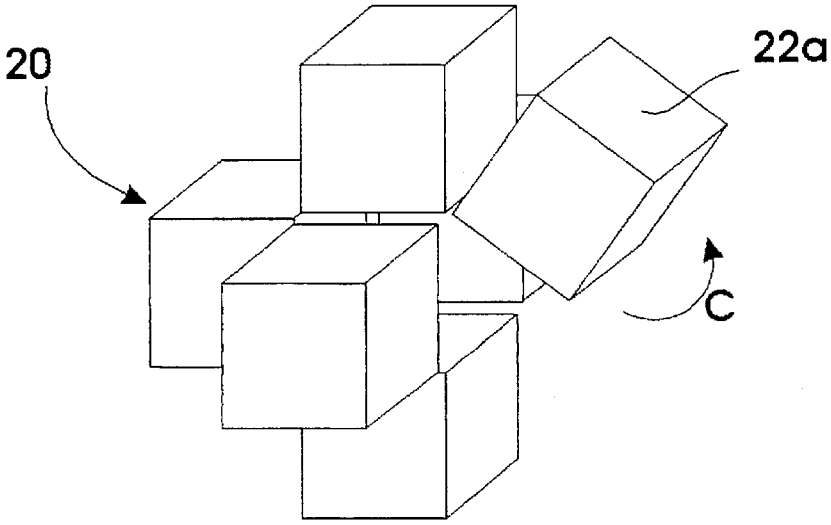
FIG. 9 shows an example of game elements' moves for the game shown in FIG.8.

Still another alternate embodiment of the game 20 is illustrated in FIG.8. In this embodiment, the game comprises game elements 22, having the shape of a cube. Each game element includes visual or tactile indicia on some or all of it's planar surfaces. Each game element further includes a plurality of means of attachment along some or all of said game element's edges. Said means of attachment connect the game elements to each other, are detachable and provide the possibility, as illustrated in FIG.9, for a game element to rotate around the game element's edge, attached to an adjacent game element (as shown by arrow C) and attach to another game element or another planar surface of the adjacent game element. The object of the game is to achieve a predefined pattern of indicia of game elements' planar surfaces by a series of rotations of different game elements. An example of a specific objective is to match colors of adjacent planar surfaces of adjacent game elements. Yet another object of the game is to create attractive shapes and/or game elements' indicia patterns.

Although the specific shape and number of game elements are described, they can be varied in order to change the relative difficulty of the game.

I claim:

1. A manipulative game comprising:

a three dimensional frame having a plurality of ribs and further having a plurality of planar sides, wherein each two adjacent planar sides have at least one common rib, a plurality of game elements, each of said game elements having a plurality of planar surfaces, containing indicia, and substantially equal to the planar sides of said frame, a plurality of detachable means of attachment connecting the edges of said game elements to the ribs of said frame, said means of attachment allowing a game element to rotate around a rib of said frame and to reconnect to a planar side of the frame, adjacent to the side of the original attachment;

the object of said game being to consequently rotate said game elements around connected means of attachment so as to achieve a predefined pattern of said game elements' indicia.

2. A game as defined in claim 1 wherein said frame has a general shape of a Platonic solid.

3. A game as defined in claim 2 wherein said game elements are substantially two dimensional.

4. A game as defined in claim 3 wherein said game elements have indicia on one planar surface.

5. A game as defined in claim 3 wherein said game elements have indicia on both planar surfaces.

6. A game as defined in claim 2 wherein said game elements are substantially three dimensional.

7. A game as defined in claim 2, comprising both two and three dimensional game elements.

8. A game as defined in claim 2 wherein said game elements include said means of attachment along all said game elements' edges.

9. A game as defined in claim 2 wherein said game elements include said means of attachment along at least two edges of said game elements.

* * * * *